US005217683A

United States Patent [19]

Causton

[11] Patent Number: 5,217,683

[45] Date of Patent: Jun. 8, 1993

[54] STEEL POWDER COMPOSITION

[75] Inventor: Robert J. Causton, Delran, N.J.

[73] Assignee: Hoeganaes Corporation, Riverton, N.J.

[21] Appl. No.: 780,722

[22] Filed: Oct. 21, 1991

Related U.S. Application Data

[62] Division of Ser. No. 695,209, May 3, 1991, Pat. No. 5,108,493.

[51] Int. Cl.[5] ..... B22F 3/12

[52] U.S. Cl. ..... 419/38; 419/39; 419/11

[58] Field of Search ..... 419/39, 11, 38; 75/255

[56] References Cited

U.S. PATENT DOCUMENTS

| | | | |
|---|---|---|---|
| 2,191,936 | 2/1940 | Lenel | 419/11 |
| 2,238,382 | 4/1941 | Boegehold | 419/33 |
| 2,382,601 | 8/1945 | Boegehold et al. | 419/23 |
| 2,852,366 | 9/1958 | Jenkins | 419/10 |
| 3,120,436 | 3/1961 | Harrison | 419/39 |
| 3,512,964 | 5/1970 | Fuchsman | 75/201 |
| 3,950,165 | 4/1976 | Oda et al. | 75/200 |
| 4,299,629 | 11/1981 | Haack | 75/251 |
| 4,614,544 | 9/1986 | Lall | 75/246 |
| 4,834,800 | 5/1989 | Semel | 106/403 |
| 4,921,665 | 5/1990 | Klar et al. | 419/23 |

FOREIGN PATENT DOCUMENTS 60-5568 7/1986 Japan .

OTHER PUBLICATIONS

G. Schlieper and F. Thümmler, "High Strength Heat--Treatable Sintered Steels Containing Manganese, Chromium, Vanadium and Molybdenum," Powder Metallury International, vol. 11, No. 4, 1979, pp. 172-176.

J. Tengzelius, S-E Grek and C-A Blände, "Limitations And Possibilities In The Utilization of Cr and Mn As Alloying Elements In High Strength Sintered Steels," Modern Developments in Powder Metallurty, vol. 12 *Principles and Processes*, pp. 159-183.

Satyajit Banerjee, Georg Schlieper, Fritz Thümmler, Gerhard Zapf, "New Results In The Master Alloy Concept For High Strength Sintered Steels," Modern Developments in Powder Metallurgy, vol. 12 *Principles and Processes*, pp. 143-157.

A. Salak, "High—Strength Sintered Manganese Steel," Modern Developments in Powder Metallurgy, vol. 12 *Principles and Processes*, pp. 183-201.

*Primary Examiner*—Donald P. Walsh
*Assistant Examiner*—Daniel J. Jenkins
*Attorney, Agent, or Firm*—Woodcock, Washburn, Kurtz, Mackiewicz & Norris

12 Claims, No Drawings

STEEL POWDER COMPOSITION

This application is a divisional application of U.S. Ser. No. 695,209 filed May 3, 1991, now U.S. Pat. No. 5,108,493.

BACKGROUND OF THE INVENTION

The present invention pertains to a powder composition, in the form of an admixture of powders of two distinct pre-alloys of iron, for the production of alloyed steel parts through powder metallurgical processes. More particularly, the invention relates to a powder composition of powders of a pre-alloy of iron with molybdenum in admixture with powders of a prealloy of iron with carbon and at least one transition element. The powder composition is useful in the manufacture, by powder-metallurgical methods, of alloyed steel precision parts with high density, good dimensional accuracy, hardenability, and strength.

Industrial users of sintered metal parts, particularly in the automotive industry, have sought a reduction in the weight of such parts without any decrease in strength. To satisfy these requirements, new powder metallurgical alloys, often with higher density and better homogeneity, have been developed. The alloying elements used today for the surface hardening of powder-metallurgical materials are primarily nickel, copper, molybdenum, carbon, and to some degree, chromium and manganese.

There are two general processes for incorporating these alloying elements into an iron powder mixture: simple mixtures of the iron powder with particles of the alloying element; and so-called pre-alloyed atomized powders. The simple powder mixtures are prepared merely by mixing the base iron powder with a particulate form of the elemental metal to be alloyed, either as the metal itself or in the form of a compound that breaks down to the metal during the sintering process. Atomized steel powders are produced from a melt of iron and the desired alloying elements, which melt is then sprayed into droplets (atomizing, generally with a jet of water) which droplets solidify upon cooling to form relatively homogeneous particles of the iron alloyed with the other elements of the melt.

One of the disadvantages of simple mixtures of iron and alloy-element particles is the risk of segregation and dusting that exists because of the general differences in particle sizes and/or densities of the various metallic elements of the mix. The pre-alloyed powders, on the other hand, whether made by atomizing or grinding, are generally free of the detriments associated with segregation since each of the particles has the desired alloying composition. The risk of dust formation is also lessened since the particles are generally of more uniform size than are particles within a simple mix of iron particles and alloy-metal particles. The pre-alloyed powders, however, have the disadvantage of low compressibility resulting from the solution-hardening effect that the alloying substances have on each powder particle. The compressibility of these alloy powders is substantially less than that of a simple mixture of elemental powders, which is essentially the same as that of the iron powder included within it.

Furthermore, although such alloying metals as chromium and manganese are efficient in strengthening steels, these and other metal alloy elements have a high affinity for oxygen and there has been the danger that the presence of such alloying elements will form oxides, particularly during the atomization step, unless very carefully controlled conditions are employed. The presence of metal oxides can hamper the sintering reaction and reduce the strength of the finally sintered product. Accordingly, although the pre-alloying of such elements through atomization is otherwise desirable, the benefits of such pre-alloying are often outweighed by the risk of oxide formation.

It is therefore an object of the present invention to provide a powder composition that has the benefit of pre-alloying, but that is not fully pre-alloyed, thereby retaining good compressibility, and that is less likely to have formed oxides during its production and is at a reduced risk of forming oxides during storage.

SUMMARY OF THE INVENTION

According to the present invention, it has been found that high quality sintered parts can be made from a steel powder composition that is an admixture of two different pre-alloyed iron-based powders, one being a prealloy of iron with molybdenum, the other being a prealloy of iron with carbon and with at least one other strength-imparting alloy element such as a transition element. More particularly, the steel powder composition of the invention comprises (a) a first pre-alloyed iron-based powder containing about 0.5–2.5 weight percent of dissolved molybdenum as an alloying element, which first powder is intimately admixed with (b) a second pre-alloyed iron-based powder containing at least about 0.15 weight percent carbon and at least about 25% by weight of a transition element component, wherein this transition element component comprises at least one element selected from the group consisting of chromium, manganese, vanadium, and columbium. The admixture is in proportions that provide at least about 0.05% by weight, preferably at least about 0.1% by weight, of the transition element component to the steel powder composition.

The first iron-based powder can contain, in addition to molybdenum, other elements pre-alloyed with the iron, but in preferred embodiments, this powder is substantially free of other pre-alloyed elements, containing a total of such other elements of less than about 0.8 weight percent, more preferably less than about 0.4 weight percent. In another preferred embodiment, the second iron-based powder contains up to about 2.0 weight percent of chromium and/or manganese as the alloyed transition element, or contains up to about 0.2 weight percent of columbium and/or vanadium as the alloyed transition element(s). The steel powder composition of this invention can be compacted and sintered to high density to provide sintered parts with good dimensional accuracy, hardness, and strength.

DETAILED DESCRIPTION OF THE INVENTION

The present invention provides a steel powder composition comprising an admixture of two different prealloyed iron-based powders. It has been found that such an admixture has advantages over a fully integrated pre-alloyed powder in which all constituents have been pre-alloyed to form a single powder from a substantially uniform and homogeneous composition. The admixture of the present invention has a compressibility that is not significantly decreased compared to a simple mixture of powders of iron and the alloy elements, yet provides many of the benefits of the fully integrated pre-alloy compositions, such as resistance to segregation and dusting, and hardness and strength of the final sintered products.

The first pre-alloyed iron-based powder component of this composition contains molybdenum as an alloying element and is generally produced by atomizing a melt of iron and the appropriate quantity of molybdenum. Generally a minimum of about 0.5 weight percent molybdenum is required to be pre-alloyed in this first powder for the strength of the final sintered product to reach a practically useful value. The upper limit of molybdenum is not critical, but beyond a total molybdenum content of about 3.0 weight percent, the powder can begin to lose compressibility. Accordingly, an upper limit of about 2.5 weight percent molybdenum is preferred. More preferred is that this first pre-alloyed powder component contain about 0.75–2.0 weight percent molybdenum, and most preferred is a quantity of about 0.75–1.5 weight percent molybdenum. A particularly useful composition has been found to be one in which the total molybdenum content of the steel powder is about 0.8–0.9 weight percent, wherein substantially all, if not the entirety, of the molybdenum present in the final steel powder composition is incorporated through this first pre-alloyed iron based powder component.

This first iron-based powder can contain elements in addition to molybdenum that are pre-alloyed with the iron, but it is generally a benefit to the practice of the invention if this first powder component of the invention is substantially free of elements pre-alloyed with the iron other than molybdenum. This first component will generally constitute a substantial portion of the weight and volume of the overall steel powder composition, and therefore the presence of significant amounts of other pre-alloyed elements could unduly lower the compressibility of that composition. Accordingly, in preferred embodiments, the total weight of other alloying elements or impurities such as manganese, chromium, silicon, copper, nickel, and aluminum, will not exceed about 0.8 weight percent, and more preferably will not exceed about 0.4 weight percent. The level of any manganese, in particular, is preferably less than about 0.25 weight percent of this first iron-based alloy. Moreover, the total carbon content of this first component preferably does not exceed about 0.02 weight percent.

This first pre-alloyed component of the composition is produced by atomizing a melt of molybdenum and iron to produce an alloyed powder with a maximum particle size of about 250 microns, more preferably a maximum of about 212 microns, and most preferably a maximum of about 150 microns. The average particle size, moreover, will preferably be in the range of about 70–100 microns. Following atomization, the powder is annealed at a temperature of about 700°–1000° C., generally in an inert or reducing atmosphere. A most preferred molybdenum-containing iron-based powder for use as this first powder component of the invention is commercially available as ANCORSTEEL 85 HP, a pre-alloy of iron with about 0.85 weight percent dissolved molybdenum and containing less than about 0.4 weight percent of other pre-alloyed elements.

The second pre-alloyed powder component of the steel powder composition of the invention is a ferroalloy of iron, carbon, and at least one transition element. The carbon constitutes at least 0.15% by total weight of the ferroalloy, preferably at least 1% by total weight, and more preferably is in the range of about 3–9% by total weight. The ferroalloy also contains at least one transition element. This transition element component of the ferroalloy must include at least one metal selected from the group consisting of chromium, manganese, vanadium, and columbium, but optionally may include one or more other transition elements as well. (As used herein, "transition element(s)" refers to those elements of atomic number 21 through 29 (excluding iron itself), 39 through 47, 57 through 79, and elements with atomic numbers 89 and greater.) Although these optional elements can be any one or more of the above-defined "transition elements," preferred among the optional transition elements are tungsten, nickel, titanium, and copper. Where one or more of these optional other transition elements will be part of the transition element component of the ferroalloy, it is nevertheless preferred that the manganese, chromium, vanadium, and/or columbium constitute at least 50 weight percent, and more preferably at least 75 weight percent, of the transition element component of the ferroalloy. Most preferred embodiments are those in which substantially no transition element other than manganese, chromium, vanadium and/or columbium is present in the ferroalloy. Although the total concentration of the transition element component of the ferroalloy is not critical, it is preferred that the transition element component constitute at least about 25% by total weight, and more preferably about 50–85% by total weight, of the ferroalloy.

It is preferred that the iron used to make this ferroalloy component be substantially free of impurities or inclusions other than metallurgical carbon or transition elements, and more specifically that the iron contain no more than a total of about 2% by weight of these impurities or inclusions. It is particularly preferred that the ferroalloy itself have no more than a total of about 0.4 weight percent of silicon and/or aluminum.

The ferroalloy can be made by methods well known in the art, by preparing a melt of the constituent metal ingredients, solidifying the melt, and then pulverizing and/or grinding the solid to an appropriate particle size. Optionally, the particles so formed can be annealed, generally at temperatures of about 700°–1000° C. In preparing the melt, the carbon, preferably in the form of powdered graphite, and the transition element or elements are combined with the iron material. After the melt has cooled and solidified, and the alloy thereby formed, the solidified product is pulverized and ground. Conventional milling equipment can be used. The ferroalloys are easily pulverized and ground to sizes that will mix uniformly with the first iron-based pre-alloy powder component of the invention. The ferroalloy is preferably ground to a maximum particle size of about 25 microns, and more specifically to a size such that 90% by weight of the particles are 20 microns or below. It is preferred that the average particle size be in the range of about 5–15 microns, and more preferably be about 10 microns.

Suitable ferroalloys are also available commercially in the form of coarse or lump powders that can be further pulverized and/or ground to provide a finer particle size, as described above. Examples of suitable commercially available products are as follows:

For a ferroalloy containing manganese, ferromanganese material available from Chemalloy, Inc. and/or Shieldalloy Metallurgical Corp., having a manganese content of at least about 78 weight percent and a carbon content of about 6–7 weight percent;

For a ferroalloy containing chromium, ferrochrome, "alpha two high carbon ferrochrome" available from Chemalloy, Inc. or High Carbon ferrochrome from Shieldalloy Metallurgical Corporation, both having a chromium content of about 60–70 weight percent and a carbon content of about 6–9 weight percent;

For a ferroalloy containing vanadium, ferrovanadium, available from Shieldalloy Metallurgical Corp. having a vanadium content of about 50–60 weight percent and a carbon content of up to about 1.5 weight percent;

For a ferroalloy containing columbium, ferrocolumbium, available from Shieldalloy Metallurgical Corp. having a columbium content of about 60–70 weight percent and a carbon content of up to about 0.3 weight percent.

The two pre-alloyed powder components are mechanically combined by conventional techniques to provide the steel powder composition of the invention as an intimate admixture. Optionally, up to about 1% by weight of a binding compound can be included in the admixture, particularly where the iron-based molybdenum alloy particles are of substantially greater size than are the particles of the carbon-containing ferroalloy. Suitable binders, as well as techniques for incorporating them into the powder mixture, are disclosed in U.S. Pat. No. 4,834,800 (issued May 1989, to Semel), U.S. Pat. No. 4,483,905 (issued November 1984, to Engström), and U.S. Pat. No. 4,676,831 (issued June 1987, to Engstrom). The disclosures of each of these references are hereby incorporated by reference.

In the preparation of the steel powder composition, the ferroalloy is combined with the molybdenum-containing alloy in such proportions that the transition element component of the ferroalloy is present in the resultant steel powder composition at a level of at least about 0.05% by total weight. That is, the final steel powder composition contains at least 0.05% by total weight of transition element(s) contributed by the second pre-alloy component. Preferably there will be at least about 0.1% up to about 4% by total weight, more preferably up to about 3% by total weight, and most preferably up to about 2% by total weight of such transition element(s) will be provided to the composition by the ferroalloy component. At transition element levels above about 4% by total weight, certain properties of steel products sintered therefrom can be harmfully affected, but those skilled in the art will recognize that for certain specialized uses, steel powder compositions containing as much as 10–15% by weight of transition element alloy material are necessary, and such levels can be provided to the steel powder composition of this invention by the use of appropriate levels of the ferroalloy. Particularly preferred steel powder compositions of the invention contain, as provided by the ferroalloy component, one or more of the following in the indicated amounts: manganese, about 0.3–2.0, preferably about 0.5–1.0, weight percent; chromium, about 0.5–2.0, preferably about 0.5–1.0, weight percent; vanadium, about 0.05–0.5, preferably about 0.1–0.2, weight percent; columbium, about 0.05–0.5, preferably about 0.1–0.2, weight percent.

In addition to the ferroalloy and the molybdenum-containing pre-alloy, the steel powder composition of the invention can also contain minor amounts of other metallurgically appropriate additives such as graphite or a temporary lubricant. Up to about 1% by weight of powdered graphite can be added, preferably having an average particle size of about 2–12 microns, and more preferably about 4–8 microns.

In use, the steel powder composition of this invention is compacted in a die at a pressure of about 30–60 tons per square inch, followed by sintering at a temperature and for a time sufficient to fully alloy the composition. Generally, sintering conditions of 2200°–2400° F. for 30–60 minutes will be employed, but it has been surprisingly found that good results can be obtained with temperatures in the range of 2050°–2100° F. as well. Normally a lubricant is mixed directly into the powder composition, usually in an amount up to about 1% by weight, although the lubricant can be applied directly to the die wall. Preferable lubricants are those that pyrolyze cleanly during sintering. Examples of such lubricants are zinc stearate and the synthetic waxes available from Glyco Chemical Company as "ACRAWAX."

The steel powder composition of the present invention is an admixture of two different pre-alloyed powders. It has been found that this admixture, as opposed to a fully integrated prealloy powder in which all constituents have been pre-alloyed from a single melt and thereafter formed into a single powder, has a compressibility that is surprisingly high. For example, compression of the powder composition of the present invention at traditional pressures of about 30–60 tons per square inch provides a "green" structure with high density, generally at least about 90% of theoretical density. In preferred embodiments, the density can exceed 94% of theoretical, and in most preferred embodiments, can exceed about 95% of theoretical. The powder composition of the present invention can be compressed to a higher green density than a fully integrated pre-alloyed powder of the same constituents, a property that can ultimately translate into higher density and strength in the final sintered products. Moreover, it has also been found that the incorporation of the desired alloying elements into the steel powder composition through an admixture of two different pre-alloyed powders, by the procedures described above, can result in a lower oxygen content in the powders and in the final sintered product. Preferably, the oxygen content of a sintered component made from the composition of the present invention will be less than about 0.08%, and preferably less than about 0.05%. EXAMPLES Steel powder compositions were prepared by intimately admixing a pre-alloyed iron-based powder containing about 0.85 weight percent dissolved molybdenum (ANCORSTEEL 85 HP, available from Hoeganaes Corporation) with a sufficient amount of ferroalloy, as specified below, to provide the indicated levels of chromium, manganese, columbium, and/or vanadium in the resultant steel powder composition. In all cases, the steel powder compositions also contained 0.4% by total weight of a commercial grade of powdered graphite and 0.5% by total weight zinc stearate as a lubricant.

The ferroalloys through which the chromium, manganese, columbium, and vanadium were incorporated into the various test compositions were as follows:

Chromium: a commercially-available ferroalloy manufacturer-specified as having about 60–70 weight percent chromium and about 6–9 weight percent carbon.

Manganese: a commercially available ferroalloy manufacturer-specified as having at least about 78 weight percent manganese and a carbon content of about 6–7 weight percent.

Vanadium: a commercially available ferroally manufacturer-specified as having a vanadium content of about 50–60 weight percent and a carbon content of up to about 1.5 weight percent.

Columbium: a commercially available ferroally manufacturer-specified as having a columbium content of about 60–70 weight percent and a carbon content of up to about 0.3 weight percent.

The test compositions were pressed into green bars at a compaction pressure of about 40 tons per square inch and then sintered in a Hayes furnace at about 2300° F. (1260° C.) in a dissociated ammonia atmosphere for about 30 minutes. Two test compositions consisting of the ANCORSTEEL 85 HP powder, the graphite, and the lubricant, but without any ferroalloy addition, were also compacted and sintered for purposes of comparison. Following sintering, the indicated properties were determined by standard techniques of the Metal Powder Industry Federation. Final composition of the samples were determined after sintering. Results, for two trials of each composition, are tabulated below.

TRIAL 1

| Alloy | Alloy Content (weight %) | Dimensional Change (%) | Transverse Rupture Strength (psi) | Yield Strength (psi) | Ultimate Tensile Strength (psi) | Elongation (%) | Sintered Carbon (weight %) | Oxygen Content (weight %) |
|---|---|---|---|---|---|---|---|---|
| Chromium | 0.5 | +0.24 | 167,400 | 59,420 | 71,560 | 1.7 | 0.36 | 0.035 |
| Chromium | 1.5 | +0.36 | 186,300 | 67,780 | 86,250 | 1.5 | 0.40 | 0.039 |
| Manganese | 0.5 | +0.06 | 164,400 | 56,150 | 69,400 | 2.2 | 0.36 | 0.036 |
| Manganese | 1.0 | +0.16 | 171,680 | 60,420 | 76,390 | 2.5 | 0.38 | 0.037 |
| Columbium | 0.1 | +0.10 | 166,380 | 51,870 | 62,230 | 1.6 | 0.35 | 0.038 |
| Columbium | 0.2 | +0.11 | 158,300 | 51,860 | 59,720 | 1.0 | 0.33 | 0.043 |
| Vanadium | 0.1 | +0.11 | 162,500 | 56,210 | 67,300 | 1.9 | 0.34 | 0.034 |
| Vanadium | 0.2 | +0.14 | 165,200 | 57,230 | 70,190 | 1.8 | 0.34 | 0.036 |
| Control | — | +0.18 | 146,200 | 49,860 | 65,720 | 3.0 | 0.34 | 0.035 |

TRIAL 1

| Alloy | Alloy Content (weight %) | Dimensional Change (%) | Transverse Rupture Strength (psi) | Yield Strength (psi) | Ultimate Tensile Strength (psi) | Elongation (%) | Sintered Carbon (weight %) | Oxygen Content (weight %) |
|---|---|---|---|---|---|---|---|---|
| Chromium | 1.0 | +0.33 | 175,420 | 63,370 | 82,050 | 1.5 | 0.42 | 0.040 |
| Chromium | 2.0 | +0.69 | 189,700 | 73,880 | 92,360 | 0.7 | 0.51 | 0.064 |
| Manganese | 0.75 | +0.10 | 155,666 | 56,150 | 71,560 | 1.9 | 0.37 | 0.034 |
| Manganese | 2.0 | +0.36 | 175,610 | 68,270 | 84,080 | 1.3 | 0.44 | 0.069 |
| Cr + Mn | 0.5 + 0.4 | +0.18 | 168,090 | 58,320 | 75,830 | 1.6 | 0.39 | 0.042 |
| Columbium | 0.5 | +0.16 | 112,450 | 36,280 | 39,720 | 0.2 | 0.30 | 0.066 |
| Vanadium | 0.5 | +0.25 | 167,745 | 60,360 | 68,350 | 0.6 | 0.32 | 0.070 |
| Control | — | +0.16 | 137,416 | 45,240 | 57,500 | 1.4 | 0.35 | 0.040 |

What is claimed is:

1. A method of making a sintered steel part comprising the steps of (1) providing a steel powder composition comprising (a) a first pre-alloyed iron-based powder containing about 0.5–3.0 percent by weight dissolved molybdenum; said first iron-based powder in intimate admixture with (b) a second pre-alloyed iron-based powder containing at least 0.15 percent by weight carbon and at least about 25% by weight of a transition element component, wherein said transition element component comprises at least one element selected from the group consisting of chromium, manganese, vanadium, and columbium;

wherein said second powder is in said admixture in a proportion to provide at least about 0.05 weight percent of said transition element component to the steel powder composition;

(2) compacting said steel powder composition in a die at a pressure of about 30–60 tons per square inch; and (3) sintering said compacted composition at a temperature of at least about 2050° F.

2. The method of claim 1 wherein said first pre-alloyed iron-based powder contains about 0.5–2.5% by weight molybdenum and is substantially free of other alloying elements.

3. The method of claim 2 wherein said second pre-alloyed iron-based powder contains at least 50% by total weight of said transition element component, and wherein at least 75% by weight of said transition element component is chromium, manganese, vanadium, columbium, or mixtures of these.

4. The method of claim 3 wherein said steel powder composition contains about 0.1–4% by total weight of said transition element component.

5. The method of claim 4 wherein steel powder composition further comprises up to about 1% by total weight of powdered graphite.

6. The method of claim 4 wherein said second pre-alloyed powder contains about 3–9% by total weight carbon.

7. The method of claim 3 wherein said steel powder composition contains about 0.3–2.0% by weight manganese.

8. The method of claim 3 wherein said steel powder composition contains about 0.5–2.0 weight percent chromium.

9. The method of claim 3 wherein said steel powder composition contains about 0.05–0.5 weight percent vanadium.

10. The method of claim 3 wherein said steel powder composition contains about 0.05–0.5 weight percent columbium.

11. The method of claim 1 wherein said sintering step is performed at a temperature range of about 2050–2400° F.

12. The method of claim 11 wherein said sintering step is performed at a temperature range of about 2050°–2100° F.

* * * * *

UNITED STATES PATENT AND TRADEMARK OFFICE

CERTIFICATE OF CORRECTION

PATENT NO. : 5,217,683

DATED : June 8, 1993

INVENTOR(S) : Robert J. Causton

It is certified that error appears in the above-identified patent and that said Letters Patent is hereby corrected as shown below:

Abstract missing from original Letters Patent (Ribbon version) and all subsequent copies.

Please insert the following on the front page:

Abstract

A steel powder composition useful in the production, by powder-metallurgical methods, of sintered parts with high density, good dimensional accuracy, hardenability, and strength is prepared from an admixture of two pre-alloyed iron powders of different compositions, the first being a pre-alloy of iron and molybdenum, and the second being a pre-alloy of iron with carbon and at least one transition element including chromium, manganese, vanadium, or columbium.

Signed and Sealed this

Fifteenth Day of March, 1994

Bruce Lehman

*Attest:*

BRUCE LEHMAN

*Attesting Officer*

*Commissioner of Patents and Trademarks*